US007481713B2

(12) United States Patent
Beckman

(10) Patent No.: US 7,481,713 B2
(45) Date of Patent: Jan. 27, 2009

(54) GOLF CLUB HEAD WITH AIMING DEVICE

(75) Inventor: Kyle Beckman, 13900 Barnsdale Ave., Bakersfield, CA (US) 93314

(73) Assignee: Kyle Beckman, Lodi, CA (US)

( * ) Notice: Subject to any disclaimer, the term of this patent is extended or adjusted under 35 U.S.C. 154(b) by 0 days.

(21) Appl. No.: 11/709,999

(22) Filed: Feb. 21, 2007

(65) Prior Publication Data

US 2007/0259735 A1 Nov. 8, 2007

Related U.S. Application Data

(60) Provisional application No. 60/797,617, filed on May 4, 2006.

(51) Int. Cl.
*A63B 69/36* (2006.01)

(52) U.S. Cl. ..... 473/220; 473/249

(58) Field of Classification Search ..... 473/219, 473/220, 223, 226, 242–254, 330–331
See application file for complete search history.

(56) References Cited

U.S. PATENT DOCUMENTS

| | | | | | |
|---|---|---|---|---|---|
| 2,787,470 | A * | 4/1957 | Barrus | ..... | 473/220 |
| 3,966,210 | A | 6/1976 | Rozmus | | |
| 4,962,931 | A | 10/1990 | Jazdzyk, Jr. | | |
| 4,986,544 | A | 1/1991 | Benson | | |
| 5,288,080 | A * | 2/1994 | Tice | ..... | 473/220 |
| 5,492,329 | A * | 2/1996 | Kronin | ..... | 473/220 |
| 5,630,764 | A * | 5/1997 | McNair | ..... | 473/220 |
| 5,676,603 | A | 10/1997 | Miller | | |
| 5,692,964 | A * | 12/1997 | Smith et al. | ..... | 473/220 |
| 5,709,616 | A | 1/1998 | Rife | | |
| 6,248,021 | B1 * | 6/2001 | Ognjanovic | ..... | 473/131 |
| 6,261,190 | B1 | 7/2001 | Ashcraft | | |
| 6,394,910 | B1 | 5/2002 | McCarthy | | |
| 6,471,600 | B2 * | 10/2002 | Tang et al. | ..... | 473/242 |
| 6,558,268 | B2 | 5/2003 | Tindale | | |
| 6,743,112 | B2 | 6/2004 | Nelson | | |
| 6,754,970 | B2 | 6/2004 | Daniels | | |
| 6,949,028 | B1 | 9/2005 | Hueber | | |
| 7,022,030 | B2 | 4/2006 | Best et al. | | |
| 7,083,524 | B2 | 8/2006 | Daniels | | |
| 7,147,569 | B2 * | 12/2006 | Tang et al. | ..... | 473/249 |
| 2006/0035718 | A1 | 2/2006 | Soracco et al. | | |
| 2006/0040763 | A1 | 2/2006 | Soracco et al. | | |
| 2006/0040764 | A1 | 2/2006 | Soracco et al. | | |

OTHER PUBLICATIONS 2 pages from Cobragolf.com website describing the King Cobra Optica SL-01 Putter, accessed on Dec. 29, 2006.
2 pages from Cobragolf.com website, entitled "Cobra Press Release", regarding introduction of the Optical SL Putter, accessed on Dec. 29, 2006.

* cited by examiner

*Primary Examiner*—Nini Legesse
(74) *Attorney, Agent, or Firm*—Klein, DeNatale, Goldner, Cooper, et al.; James M. Duncan, Esq.

(57) ABSTRACT

A golf club head comprises an aiming device defined by one or more openings disposed above a light emitting member. The openings may have a variety of shapes. The golf club head is configured to selectively retain or release the light emitting member, allowing the golfer to change out the light emitting member as desired for particular lighting conditions. The light emitting member may be in a variety of colors, including red, green, yellow, pink, orange, and blue.

19 Claims, 12 Drawing Sheets

GOLF CLUB HEAD WITH AIMING DEVICE

CROSS-REFERENCE TO RELATED APPLICATION

U.S. Provisional Application No. 60/797,617 for this invention was filed on May 4, 2006 for which the inventor claims domestic priority.

BACKGROUND OF THE INVENTION

The present invention generally relates to the game of golf and more particularly to a golf club head which provides a interchangeable sighting guide which utilizes the light gathering properties of fiber optic materials to assist the golfer in aiming his or her putt.

Various golf club sighting devices are known for improving a golfer's ability to aim a golf shot or putt. Perhaps the most common method of aligning a golf ball with the center of the club is by providing a notched or scribed line at a ninety degree angle to the club face. The line can be of varying width and length, and is sometimes painted to stand out against the color of the club head. If the line is notched or scribed, it can also be of varying depth into the surface of the club head. Sometimes there are a plurality of lines either notched or painted in the club head. Other devices and methods have been employed to assist golfers in correctly lining up the club head, the ball, and the target (i.e., the fairway, green, or cup).

Depending upon the lighting conditions, including the time of day, cloud cover, shade, glare, etc., it can be difficult to see the sighting device and lining up the club head, the ball and the target. A sighting device which is effective in one lighting condition may not work at all in another lighting condition. However, it would be expensive to have different clubs, such as putters, depending upon the changing lighting conditions, and would increase the number of clubs a golfer would carry.

SUMMARY OF THE INVENTION

The present invention is directed to a golf club head comprising an aiming device which responds to the needs identified above. An embodiment of the device comprises a golf club head having a front member and a back member. The front member has a forward facing ball striking surface, an upward facing top, and a rearward facing back surface. The back member, which is attached to the rearward facing back surface, comprises a receiving member and its own upward facing top. The receiving member comprises means for receiving a light emitting member, the light emitting member comprising a light gathering surface and a light emitting surface. The receiving member further comprises means for selectively retaining or releasing the light emitting member. The receiving member further comprises one or openings adjacent to the light gathering surface so that light may be absorbed into the light emitting means. The upward facing top of the back member has one or more openings adjacent to the light emitting surface which makes the light emitting surface of the light emitting member visible to the golfer. The openings in the upward facing top have a variety of shapes which define the sighting device. For example, if the opening is a straight line, the golfer will see the light emitting surface in the configuration of a straight line, thereby defining the sighting device. Alternatively, the openings may be configured as a line of circles, such that the sighting device defined by the lighting emitting surface visible through the openings is a line of circles.

Because the receiving member comprises means for selectively retaining or releasing the light emitting member, the golfer may change out one light emitting member and install another depending upon the light conditions. For example, depending upon the light conditions, a red light emitting member may provide a more effective sighting device than the green light emitting member presently installed in the putter head. This features allows the golfer, in a relatively easy manner, release the green light emitting member and install the red light emitting member.

DETAILED DESCRIPTION OF THE EMBODIMENTS

Figure 1A:
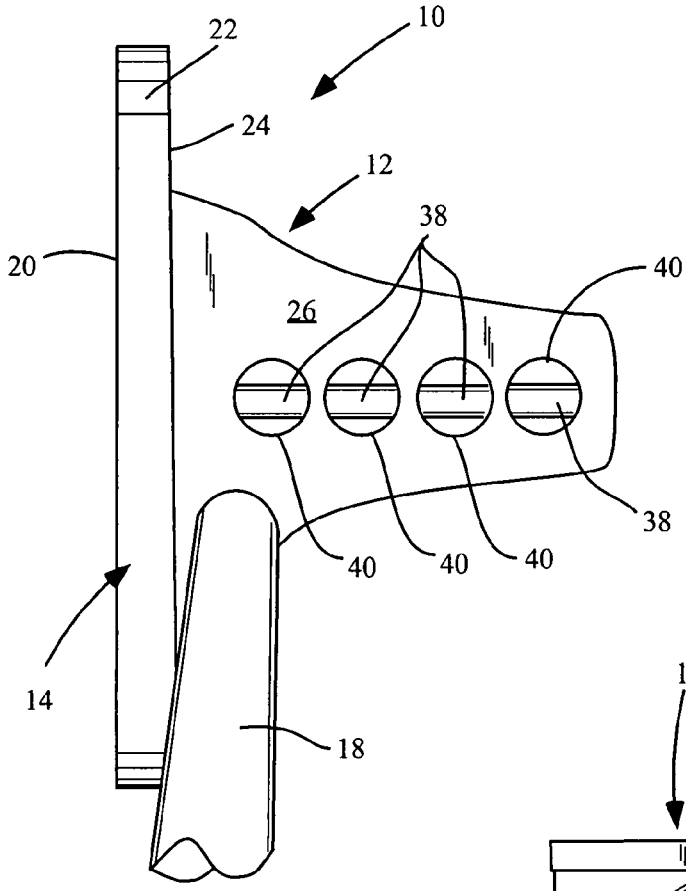
FIG. 1A shows a top view of a putter having an embodiment of the disclosed sighting device.
Figure 1B:
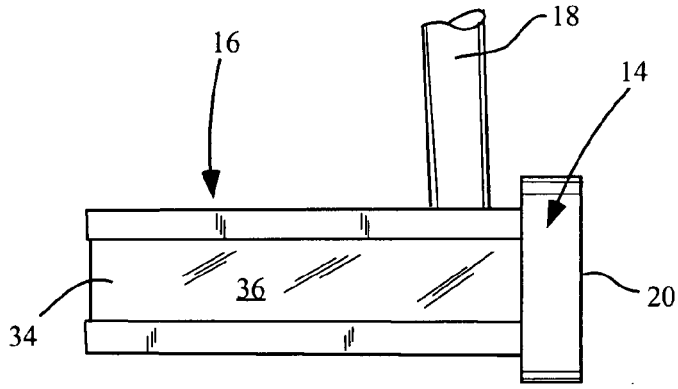
FIG. 1B shows a side view of the putter shown in FIG. 1A.
Figure 1C:
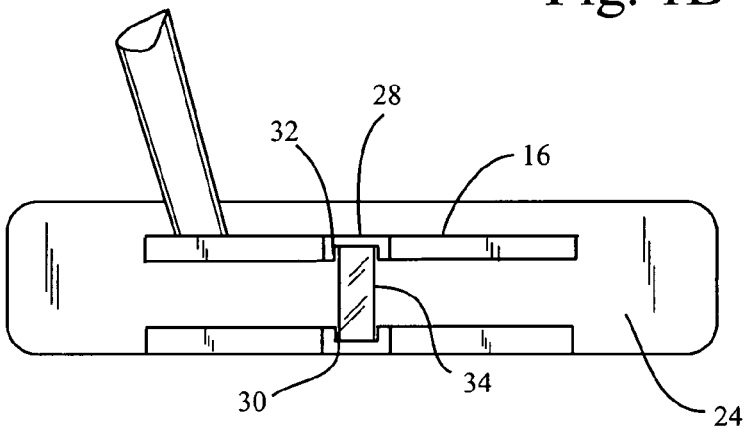
FIG. 1C shows a rear view of the putter shown in FIG. 1A.

Referring now specifically to the drawings, FIGS. 1A through 1C show an embodiment 10 of the disclosed golf club head. This embodiment 10 comprises a golf club head 12 having a front member 14 and a back member 16. As shown in the figures, the golf club head 12 has an upwardly extending shaft 18 which is grasped by the golfer at the shaft's upward end. The front member 14 has a forward facing ball striking surface 20. The front member 14 further comprises an upward facing top 22 and a rearward facing back surface 24. The back member 16 is attached to the rearward facing back surface 24. The back member 16 comprises an upwardly facing top 26.

The back member 16 further comprises receiving member 28. The receiving member 28 comprises means, such as a first channel member and an opposite facing second channel member, for receiving the light emitting member 34. For example, as shown in various figures, the receiving member 28 may comprise an upwardly facing channel member 30 and a downwardly facing channel member 32. The light emitting member 34 may comprise a variety of materials which have the property of gather light and transmitting and/or focusing the gathered light to another location on the body of the light emitting member comprising a light gathering surface and a light emitting surface. As shown in FIGS. 1A and 1B, light emitting member 34 comprises a light gathering surface 36 and a light emitting surface 38. It is to be appreciated that the light emitting surface 38 may comprise not only a planar surface, but also may also comprise linear structures, such as an edge of the light emitting member 38.

Figure 2:
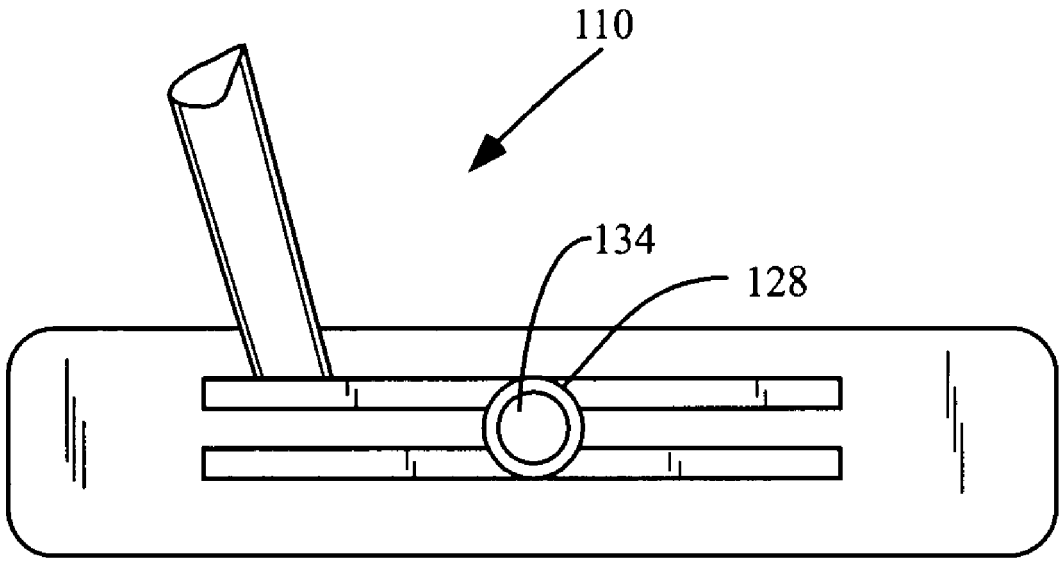
FIG. 2 shows a rear view of a putter showing an embodiment of the disclosed sighting device which utilizes a cylindrical optical or fluorescent fiber as the light emitting member.

The light emitting member 34 may comprise fiber optic material which is composed of a core layer of material impregnated with a fluorescing compound which reacts to light. This core layer is surrounded by a thin sheathing layer that has a different index of refraction. Ultraviolet light enters through the sides of the fiber and is trapped within the fiber because it cannot reflect back out through the sheath because of the difference in refractive indexes between the core and the sheath. The UV light causes the material in the core to fluoresce and emit visible light out the end of the tube. The longer the tube the more light is captured and emitted out the end. An embodiment 110 of the device showing the mounting of a cylindrically-shaped optical fiber as the light emitting 34' is shown in FIG. 2. In this embodiment 110, a modified receiving member 128 is utilized for receiving and retaining the light emitting member 134.

Alternatively, the light emitting member 34 may comprise a light gathering and transmitting material, such as polymethyl methacrylate ("PMMA"), which is also referred to as acrylic glass or simply acrylic, and sold under the names PLEXIGLAS, LUCITE, and other trade names. The light transmitting properties of PMMA are relatively very good, where PMMA transmits up to 93% more visible light than glass and does not filter ultraviolet light.

Alternatively, the light emitting member 34 may comprise a fluorescent fiber comprising a polystyrene fiber surrounded by a clear acrylic. Fluorescent dyes are added to the core, such the dyes absorb ultraviolet light and emit visible light and light refracted within the core and reflected to the ends of the fiber.

Figure 3A:
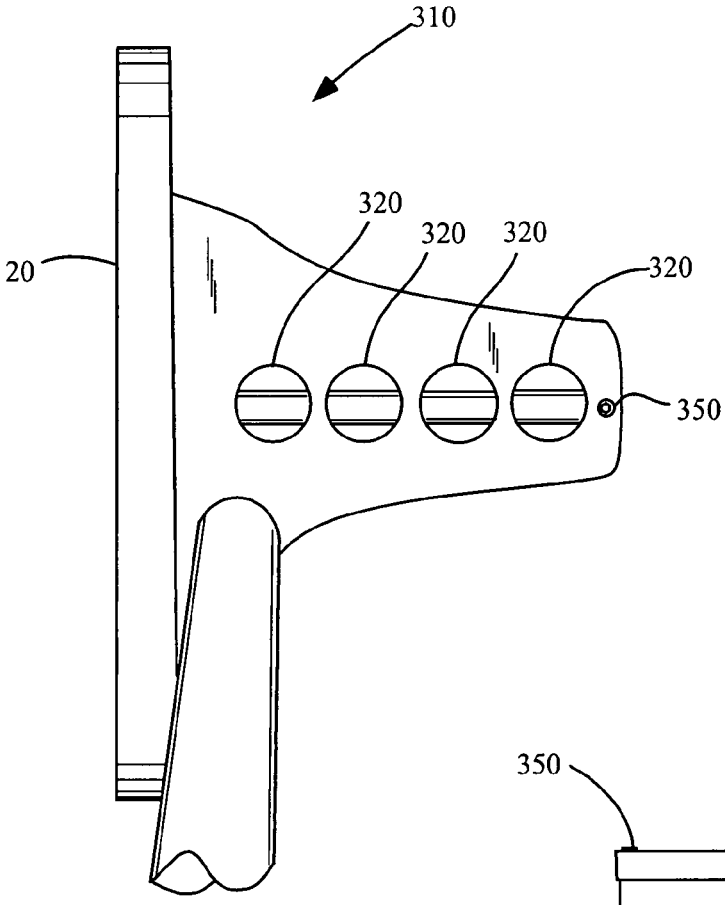
FIG. 3A shows a top view of a putter having an embodiment of the disclosed sighting device.
Figure 3B:
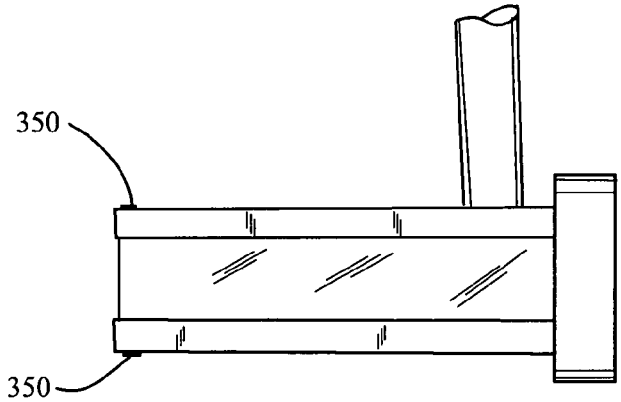
FIG. 3B shows a side view of the putter shown in FIG. 3A.
Figure 3C:
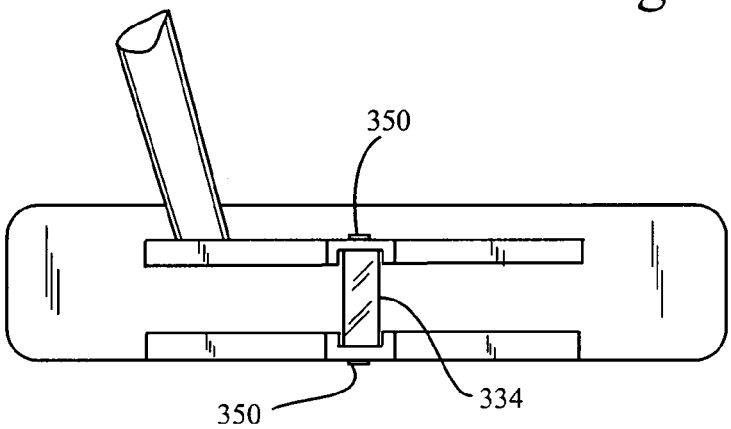
FIG. 3C shows a rear view of the putter shown in FIG. 3A.

The receiving member 28 further comprises means for selectively retaining or releasing the light emitting member 34. For example, first channel member, such as upwardly facing channel member 30, and opposite facing second channel member, such as downwardly facing channel member 32, and light emitting member 34 may be configured such that there is an interference fit between the respective channel members and the light emitting member. Alternatively, as shown for the embodiment 310 shown in FIG. 3C, the means for selectively retaining or releasing the light emitting member 334 may comprise set screws 350 which engage the light emitting member and retain it in place. Other means for selectively retaining or releasing the light emitting member 34 from the receiving member 28 may comprise spring clips, hook and loop fasteners, or locking tabs.

The means for selectively retaining or releasing the light emitting member 34 allows the light emitting member 34 to be changed out as desired by the golfer to implement a desired light emitting member. For particular lighting conditions, a golfer might prefer different colors of the light emitting member. The light emitting member may comprise a clear material which emits uncolored light. Alternatively, the light emitting member may comprise red, yellow, pink, green, orange, blue, or assorted other colors which the golfer may find effective in the particular light conditions.

The receiving member 28 further comprises one or more openings adjacent to the light gathering surface 36 so that light may be absorbed into the light emitting member and transmitted to the light emitting surface 38. For the upwardly facing channel member 30 and downwardly facing channel member 32 shown in most of the figures herein, the opening is simply the space between the channel members as shown, for example, in FIG. 1B, where the light gathering surface 36 is exposed. However it is to be appreciated that the receiving member 28 might be configured differently and different types of openings utilized to expose the light gathering surface 36 to sources of light. It is also to be appreciated that the more surface area of the light gathering surface 36 which is exposed to ambient light, the greater the light will be transferred to the light emitting surface 38.

The upwardly facing top 26 of the back member 16 has one or more openings adjacent to the light emitting surface which makes the light emitting surface of the light emitting member visible to the golfer. The openings in the upward facing top 26 may have a variety of shapes which define the sighting device. For example, for the embodiment 10 shown in FIG. 1A, the upward facing top 26 comprises a plurality of uniformly sized circular openings 40, where the light emitting surface 38 is visible through the openings, with the center of the light emitting surface viewed through each opening defining a straight line (the "sighting line") which is perpendicular to the forward facing ball striking surface 20, and where the sighting line bisects the forward facing ball striking surface. The sighting line provides the golfer with a highly visible reference to properly line up the center of the club head with the ball and the desired placement location for the golf shot.

Figure 4A:
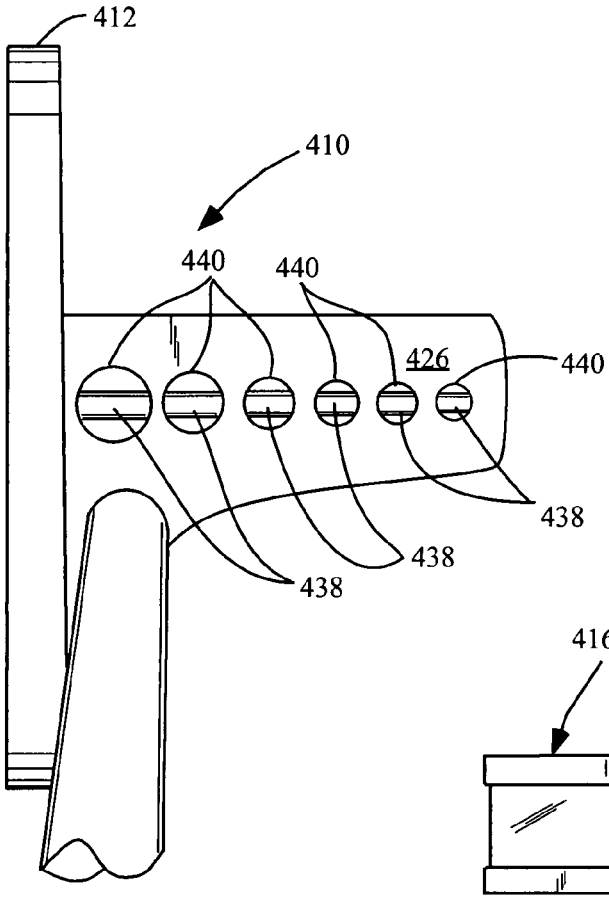
FIG. 4A shows a top view of a putter having an embodiment of the disclosed sighting device.
Figure 4B:
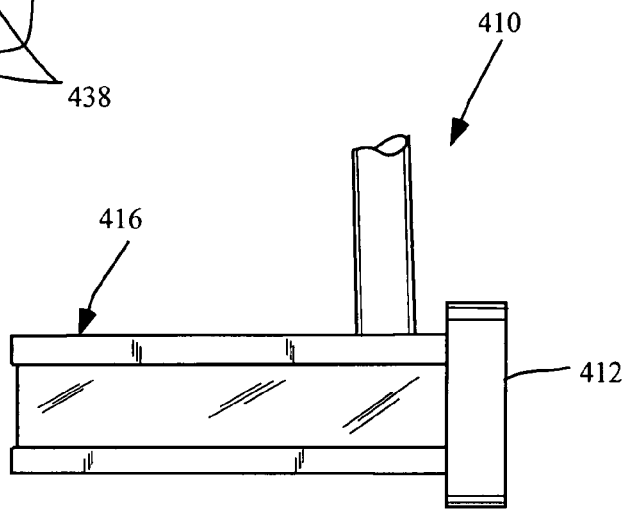
FIG. 4B shows a side view of the putter shown in FIG. 4A.
Figure 4C:
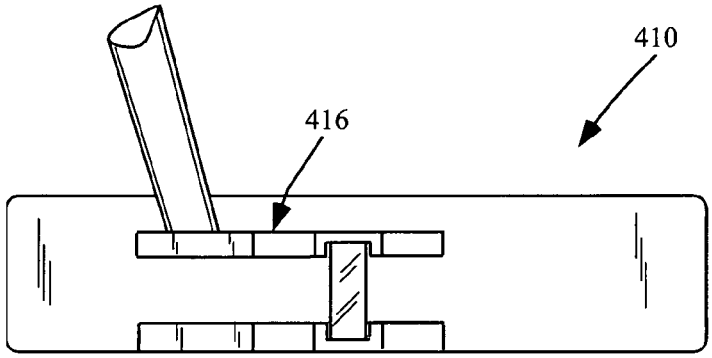
FIG. 4C shows a rear view of the putter shown in FIG. 4A.

FIGS. 4A through 4C show another embodiment 410 of the disclosed apparatus. This embodiment 410 shows a different configuration of the back member 416, wherein the upwardly facing top 426 has a plurality of circular openings 440 which are not uniform in size, but increase in diameter as the openings are closer to the club head 412. Similar to the other embodiments, a light emitting surface 438 is visible through the openings, with the center of the light emitting surface viewed through each opening.

Figure 5A:
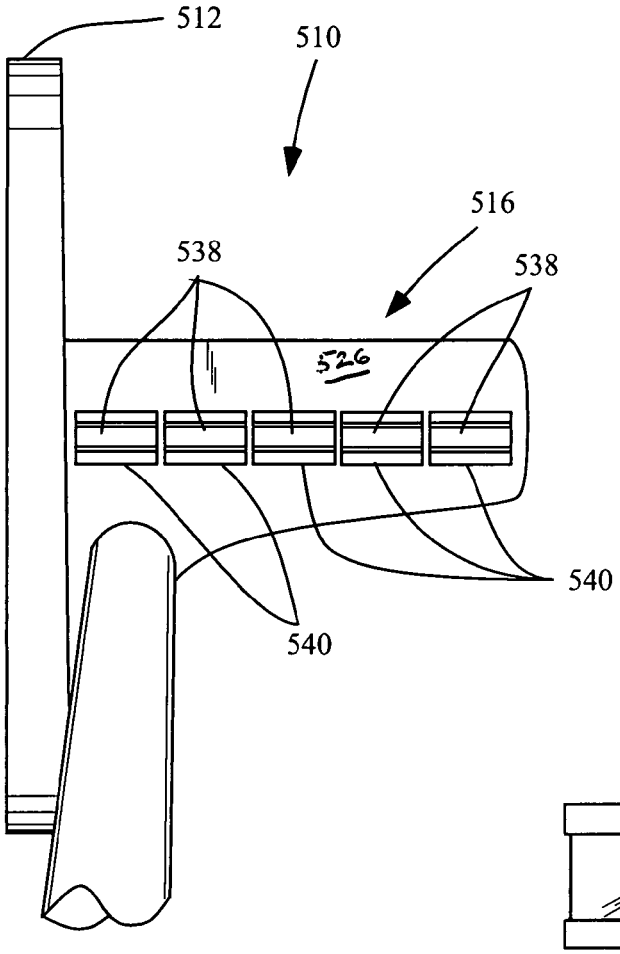
FIG. 5A shows a top view of a putter having an embodiment of the disclosed sighting device.
Figure 5B:
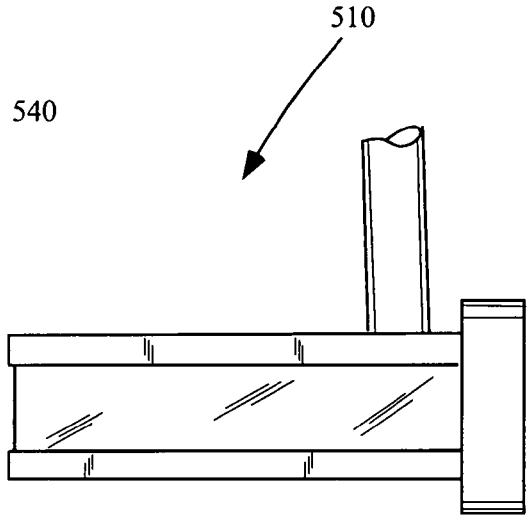
FIG. 5B shows a rear view of the putter shown in FIG. 5A.
Figure 5C:
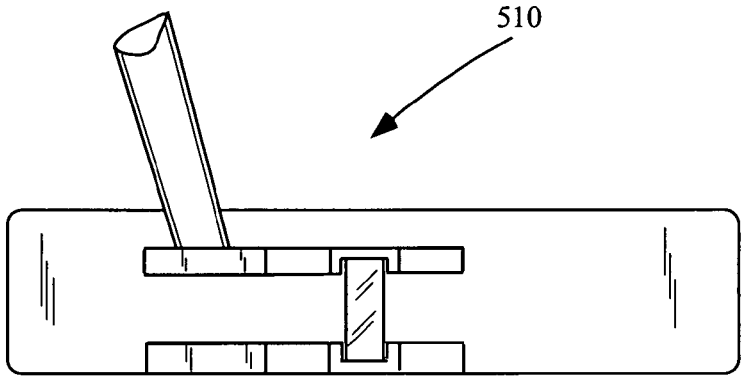
FIG. 5C shows a rear view of the putter shown in FIG. 5A.

FIGS. 5A through 5C show another embodiment 510 of the disclosed apparatus. This embodiment 510 shows a different configuration of the back member 516, wherein the upwardly facing top 526 has a plurality of rectangular openings 540 which are uniform in size as the openings approach the club head 512. but where the long axis of each rectangular opening is perpendicular to the long axis of the club head 512. Similar to the other embodiments, a light emitting surface 538 is visible through the openings, with the center of the light emitting surface viewed through each opening.

Figure 6A:
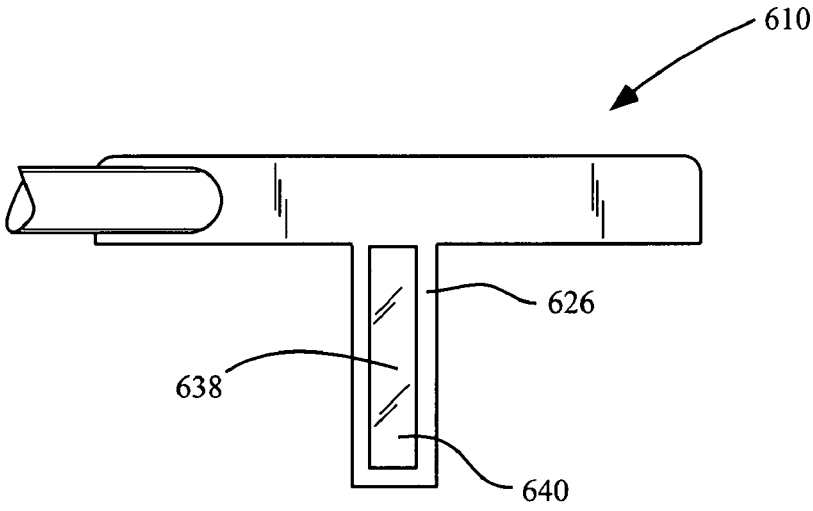
FIG. 6A shows a top view of a putter having an embodiment of the disclosed sighting device.
Figure 6B:
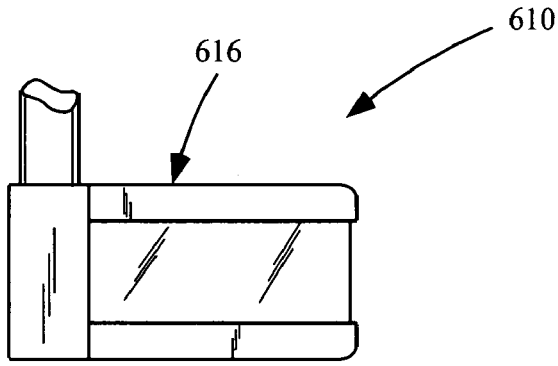
FIG. 6B shows a side view of the putter shown in FIG. 6A.
Figure 6C:
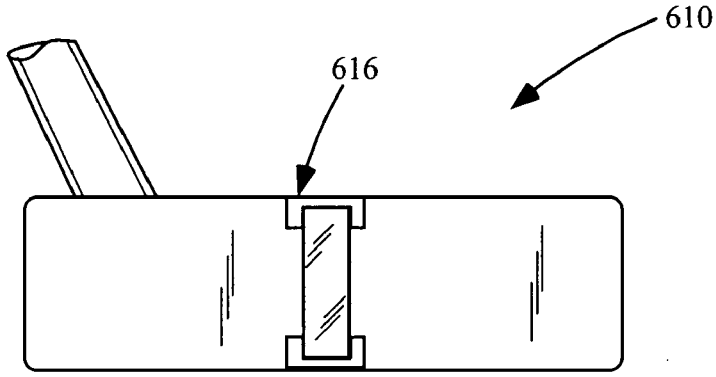
FIG. 6C shows a rear view of the putter shown in FIG. 6A.

FIGS. 6A through 6C show another embodiment 610 of the disclosed apparatus. This embodiment 610 shows a different configuration of the back member 616. Among other variations, in this embodiment 610, the upwardly facing top 626 has a single rectangular opening 640 through which the light emitting surface 638 is visible through the opening, and completely fills the opening.

Figure 7A:
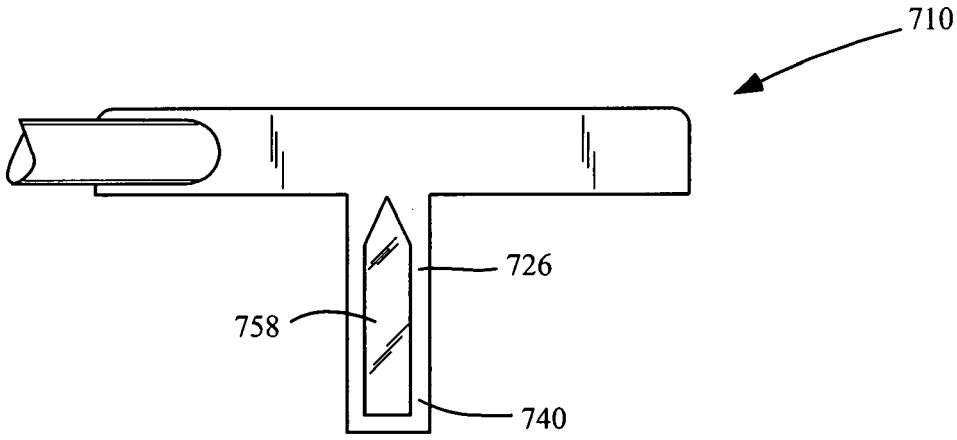
FIG. 7A shows a top view of a putter having an embodiment of the disclosed sighting device.
Figure 7B:
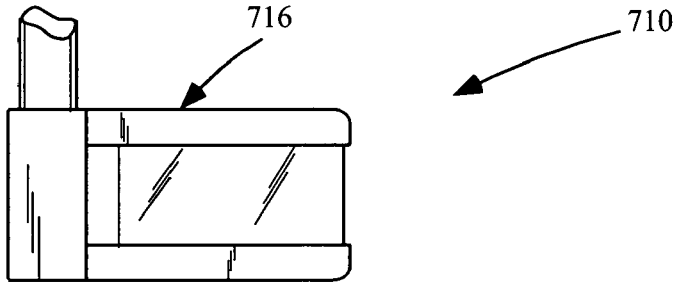
FIG. 7B shows a side view of the putter shown in FIG. 7A.
Figure 7C:
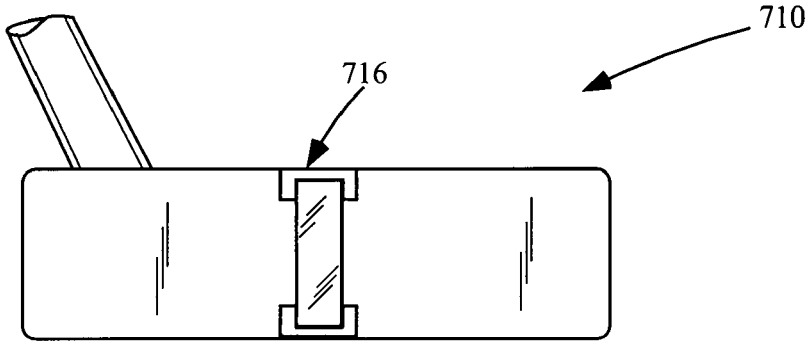
FIG. 7C shows a rear view of the putter shown in FIG. 7A.

FIGS. 7A through 7C show another embodiment 710 of the disclosed apparatus. This embodiment 710 shows a different configuration of the back member 716. In this embodiment 710, the upwardly facing top 726 has an opening 740 in the configuration of an arrow through which the light emitting surface 738 is visible through the opening and completely fills the opening.

Figure 8A:
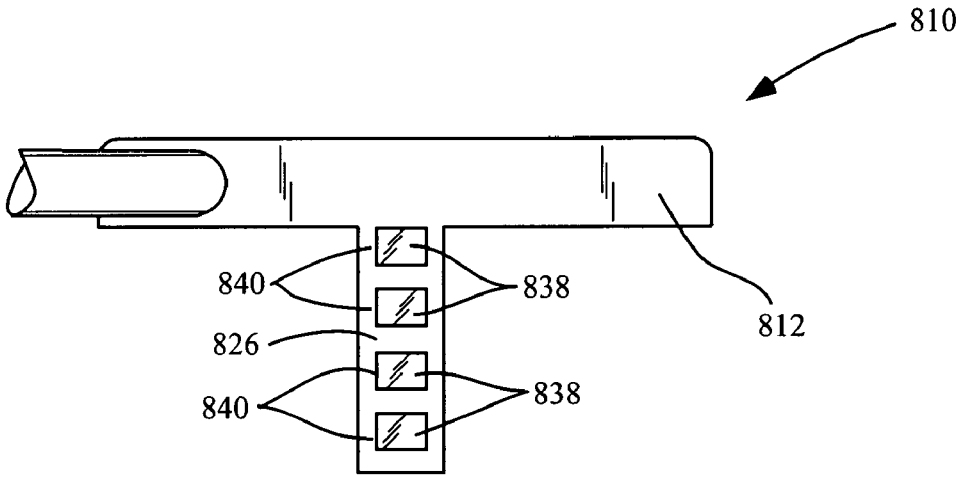
FIG. 8A shows a top view of a putter having an embodiment of the disclosed sighting device.
Figure 8B:
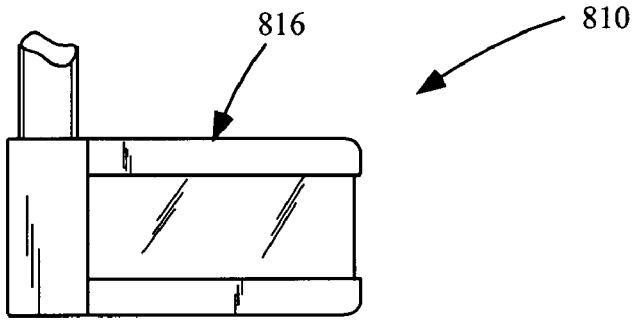
FIG. 8B shows a side view of the putter shown in FIG. 8A.
Figure 8C:
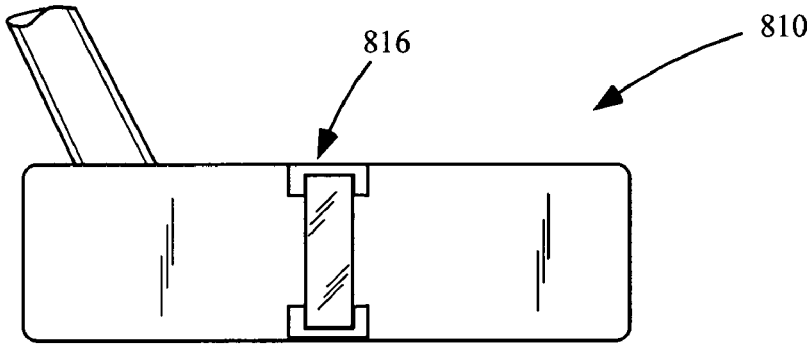
FIG. 8C shows a rear view of the putter shown in FIG. 8A.

FIGS. 8A through 8C show another embodiment 810 of the disclosed apparatus. This embodiment 810 shows a different configuration of the back member 816, wherein the upwardly facing top 826 has a plurality of rectangular openings 840 which are uniform in size as the openings approach the club head 812, but where the long axis of each rectangular opening is parallel to the long axis of the club head 812. Similar to the other embodiments, a light emitting surface 838 is visible through the openings, and completely fills each opening.

Figure 9A:
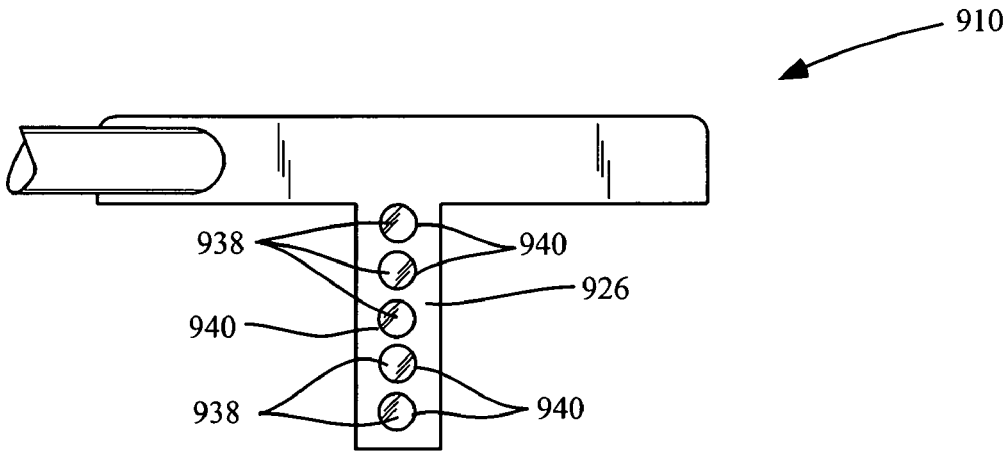
FIG. 9A shows a top view of a putter having an embodiment of the disclosed sighting device.
Figure 9B:
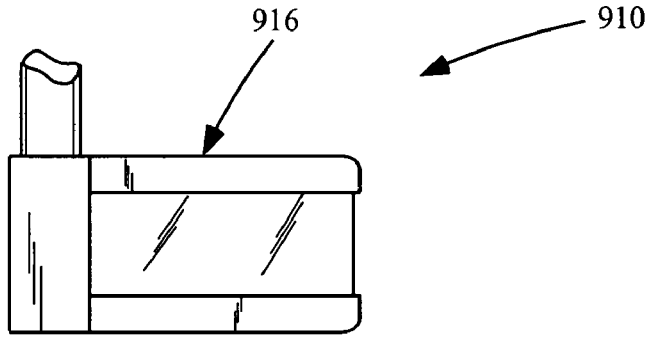
FIG. 9B shows a side view of the putter shown in FIG. 9A.
Figure 9C:
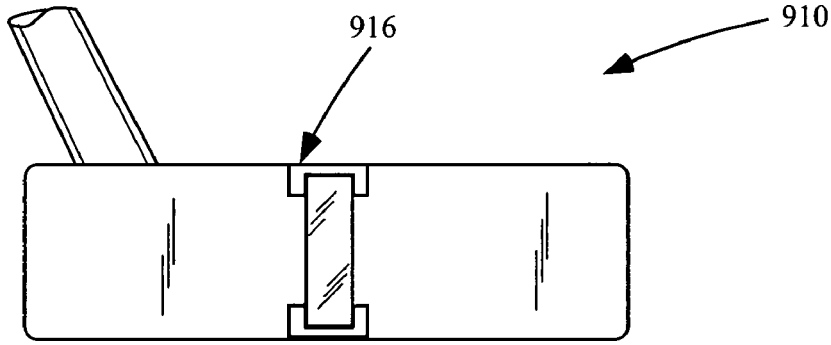
FIG. 9C shows a rear view of the putter shown in FIG. 9A.

FIGS. 9A through 9C show another embodiment 910 of the disclosed apparatus. This embodiment 910 shows a different configuration of the back member 916, wherein the upwardly facing top 926 has a plurality of circular openings 940 which are uniform in size as the openings approach the club head 912. Similar to the other embodiments, a light emitting surface 938 is visible through the openings, and completely fills each opening.

Figure 10A:
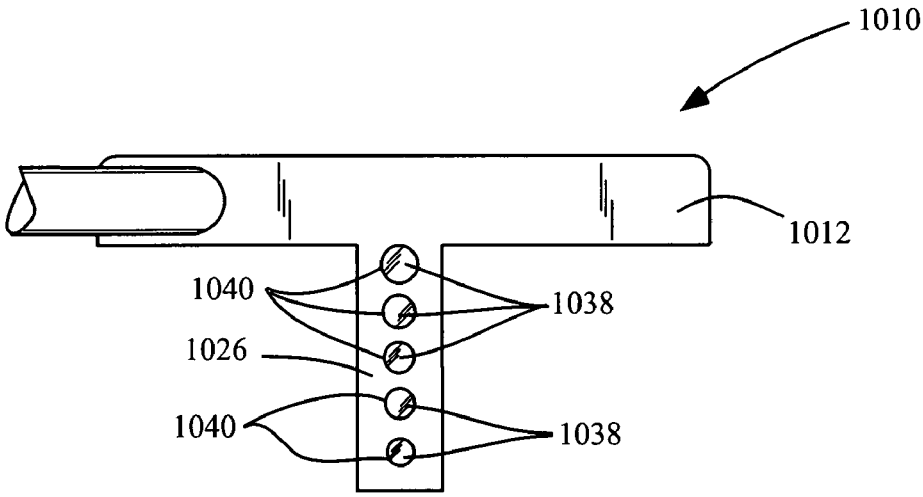
FIG. 10A shows a top view of a putter having an embodiment of the disclosed sighting device.
Figure 10B:
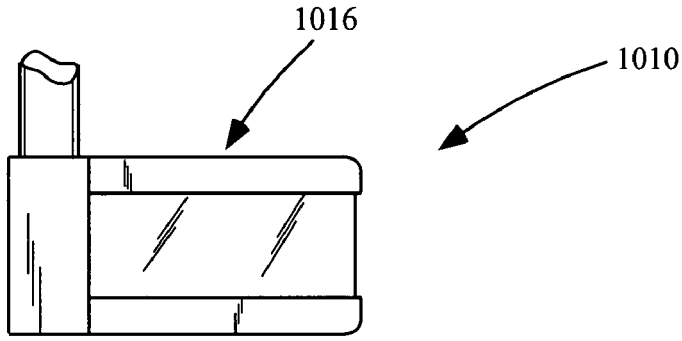
FIG. 10B shows a side view of the putter shown in FIG. 10A.
Figure 10C:
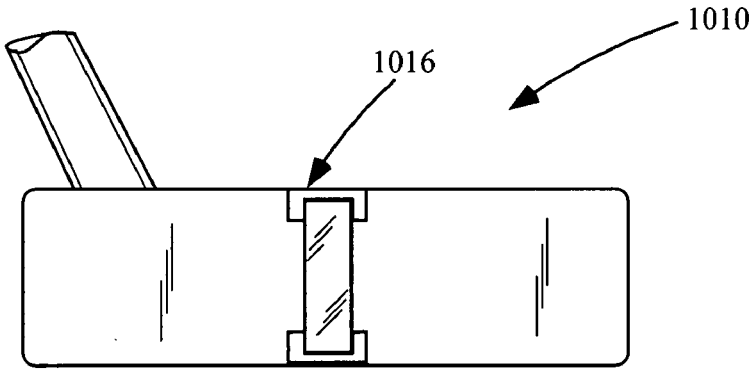
FIG. 10C shows a rear view of the putter shown in FIG. 10A.

FIGS. 10A through 10C show another embodiment 1010 of the disclosed apparatus. This embodiment 1010 shows a different configuration of the back member 1016, wherein the upwardly facing top 1026 has a plurality of circular openings 1040 which are non-uniform in size and get larger as the openings approach the club head 1012. Similar to the other embodiments, a light emitting surface 1038 is visible through the openings, and completely fills each opening.

Figure 11:
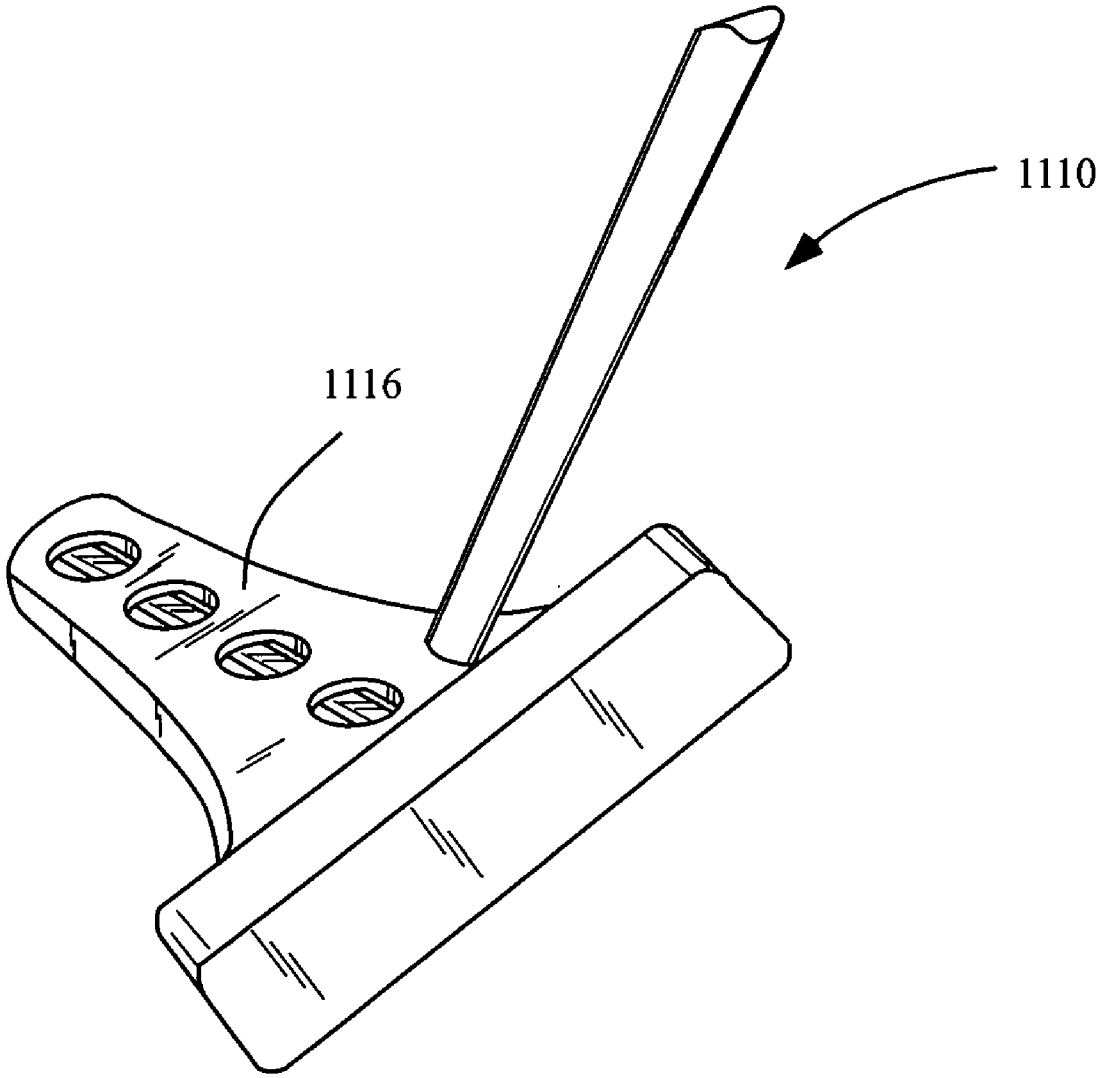
FIG. 11 shows a perspective view of a putter utilizing an embodiment of the disclosed sighting device.
Figure 12A:
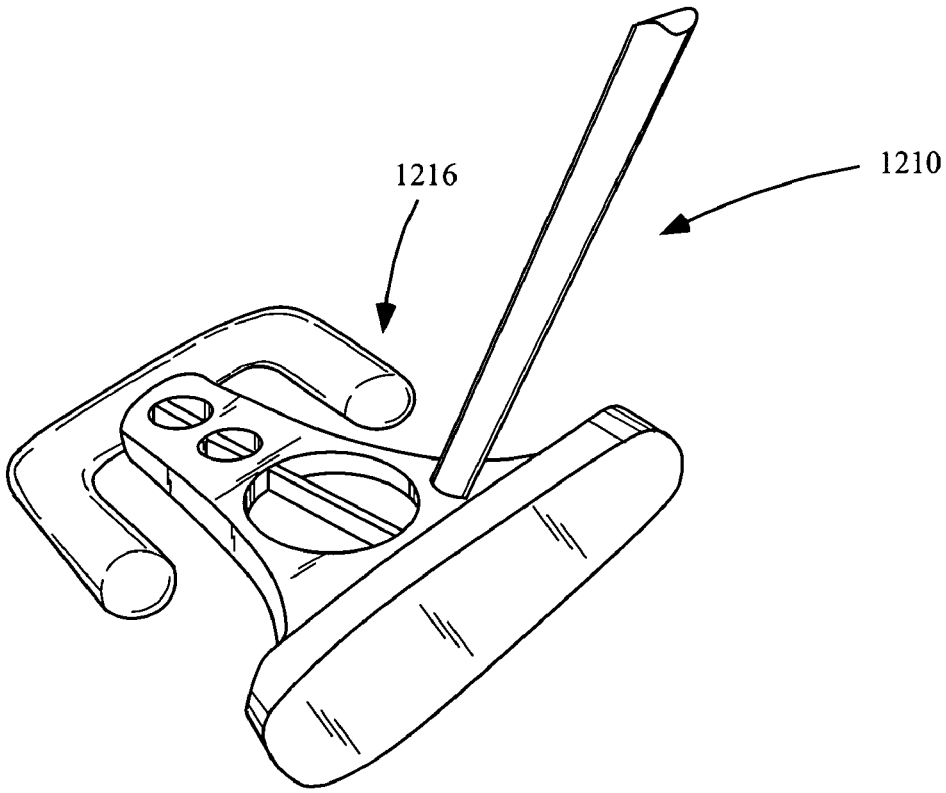
FIG. 12A shows a perspective view of a putter utilizing an embodiment of the disclosed sighting device.
Figure 12B:
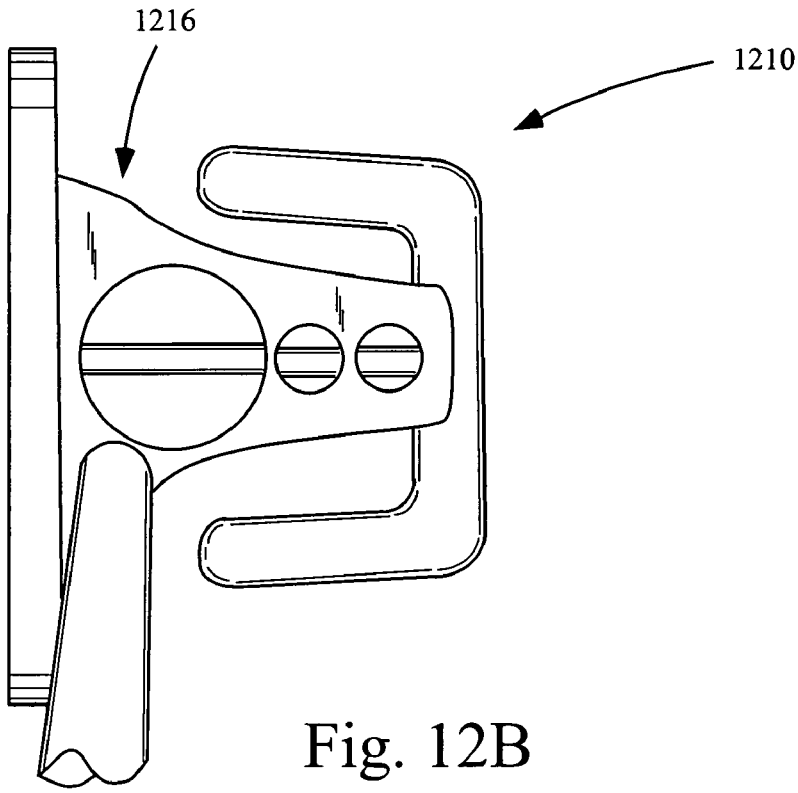
FIG. 12B shows a top view of the putter shown in FIG. 12A.

FIG. 11 shows another embodiment 1110 of the disclosed apparatus, which utilizes a different back member 1116. Likewise, FIGS. 12A and 12B show another embodiment 1210, which utilizes yet another form of a back member 1216. These figures show that the configuration of the golf club head may be changed without changing the application of the sighting apparatus.

As exemplified by the several embodiments disclosed herein, it is to be appreciated that the sighting apparatus may be used with golf club heads having a variety of different design characteristics without departing from the scope of the present invention. In addition to the fabrication of golf club heads which utilize the sighting apparatus, it is to be appreciated that existing golf club heads might be modified or adapted to receive the sighting apparatus described herein.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A golf club head, comprising:

a front member having a forward facing ball striking surface, a first upward facing top, and a rearward facing back surface;

a back member attached to the rearward facing back surface, the back member comprising a receiving member for receiving a light emitting member, the light emitting member comprising a light gathering surface and a light emitting surface, the receiving member further comprising a first channel member and an opposite facing second channel member for selectively retaining or releasing the light emitting member, the receiving member further comprising one or more openings adjacent to the light gathering surface; and the back member further comprising an upwardly facing top, the upwardly facing top having one or more openings adjacent to the light emitting surface which define a sighting line perpendicular to the forward facing ball striking surface.

2. The golf club head of claim 1 wherein the light emitting member comprises fiber optic material.

3. The golf club head of claim 1 wherein the light emitting member comprises polymethyl methacrylate.

4. The golf club head of claim 1 wherein the light emitting member comprises a fluorescent fiber comprising a polystyrene fiber.

5. The golf club head of claim 1 wherein the first channel member comprises an upwardly facing channel member and the second channel member comprises a downwardly facing channel member.

6. The golf club head of claim 1 wherein the light emitting member is held within the first channel member and the opposite facing second channel member by an interference fit between the first channel member, the second channel member, and the light emitting member.

7. The golf club head of claim 1 wherein light emitting member is held within the first channel member and the opposite facing second channel member by a set screw.

8. The golf club head of claim 1 wherein the sighting line is defined by a plurality of openings.

9. The golf club head of claim 8 wherein the plurality of openings are circular and uniformly sized.

10. The golf club head of claim 8 wherein the plurality of openings are circular and non-uniformly sized.

11. The golf club head of claim 8 wherein the plurality of openings are rectangular and uniformly sized.

12. The golf club head of claim 8 wherein the plurality of openings are rectangular and non-uniformly sized

13. The golf club head of claim 1 wherein the sighting line is defied by a rectangular opening.

14. The golf club head of claim 1 wherein the sighting line is defined by an arrow-shaped opening.

15. The golf club head of claim 1 wherein the light emitting member is red.

16. The golf club head of claim 1 wherein the light emitting member is green.

17. The golf club head of claim 1 wherein the light emitting member is yellow.

18. The golf club head of claim 1 where in the light emitting member pink.

19. The golf club head of claim 1 wherein the light emitting member is blue.

* * * * *